United States Patent [19]

Kando et al.

[11] 4,027,369

[45] June 7, 1977

[54] ELEMENT ROWS COUPLING TOOL FOR A CONCEALED SLIDE FASTENER

[75] Inventors: Akiyoshi Kando, Uozu; Ryoichi Kindai, Toyama, both of Japan

[73] Assignee: Yoshida Kogyo Kabushiki Kaisha, Japan

[22] Filed: Oct. 15, 1976

[21] Appl. No.: 732,854

[30] Foreign Application Priority Data

Oct. 23, 1975 Japan ..... 50-127679

[52] U.S. Cl. ..... 29/766; 29/768; 29/270; 24/205.15 E; 81/3 R

[51] Int. Cl.[2] ..... B23P 19/04

[58] Field of Search ..... 29/207.5 R, 207.5 SL, 29/408, 409, 200 H, 235, 243.5, 243.57, 243.58; 81/3 R, 5.1 R, 425 R, 425 A; 24/205 R, 205.15 E, 205.15 H, 201 C

[56] References Cited

UNITED STATES PATENTS

| | | | |
|---|---|---|---|
| 1,452,372 | 4/1923 | Gomez | 24/205.15 E |
| 3,404,437 | 10/1968 | Plummer | 24/205.15 E X |
| 3,572,191 | 3/1971 | Bannies | 24/205.15 E X |
| 3,745,636 | 7/1973 | Burstein | 29/207.5 SL |
| 3,808,665 | 5/1974 | Bannies | 24/205.15 E X |

*Primary Examiner*—Victor A. DiPalma
*Attorney, Agent, or Firm*—Bucknam and Archer

[57] ABSTRACT

A tool for interengaging a pair of element rows in a concealed type slide fastener has a pair of blocks movable toward and away from each other and normally urged apart, and a pair of slider body halves mounted on the blocks, respectively, the slider halves being matable to provide a slider body when the blocks are moved toward each other. An element guide is formed centrally on the bottom surface of a pivotable member operatively connected to the blocks. The pivotable member is movable pivotally into a position in which the element guide and the slider body halves are put together to jointly provide a slider when the blocks are moved toward each other. A motion converting means is provided for converting motion of the blocks into pivotal motion of the pivotable member.

7 Claims, 6 Drawing Figures

ELEMENT ROWS COUPLING TOOL FOR A CONCEALED SLIDE FASTENER

BACKGROUND OF THE INVENTION

This invention relates to a tool for coupling or interengaging a pair of element rows in a concealed type slide fastener.

Stringers of slide fasteners are meeting with increasing usage in edge-to-edge connection between artificial lawn sheets, carpets, or other similar coverings. These covering sheets, once connected, do not require frequent separation. For this reason, use of a usual slider on each pair of fastener stringers is expensive and wasteful. There has long existed the need for a suitable device which is employable as a slider to couple the fastener stringers and, after the stringers are put together, is removable therefrom to provide a sliderless slide fastener.

SUMMARY OF THE INVENTION

Accordingly, it is a primary object of the invention to provide a tool for interengaging a pair of element rows on concealed fastener stringers attached to coverings such as artificial lawn sheets.

It is another object of the invention to provide an element rows coupling tool having means operable as a slider when in use and separable for removal from the engaged element rows.

Still another object of the invention is to provide a tool for interengaging a pair of fastener element rows easily and reliably.

According to the invention, a pair of slider body halves are formed on distal ends of a pair of plates supported by a pair of blocks that are movable toward and away from each other, and are normally urged apart by means of a spring. When the blocks are moved toward each other, the slider body halves are mated to provide a slider body. The blocks carry a pair of support plates between which a pivotable member is operatively connected through a motion converting means. The pivotable member has centrally on its bottom surface an element guide. When the support plates are brought together, the motion converting means enables the pivotable member to pivot into a position in which the element guide and the mated slider body halves jointly provide a slider for a concealed type slide fastener.

Other objects, features and advantages of the present invention will be apparent from the following detailed description taken in conjunction with the accompanying drawings.

DETAILED DESCRIPTION OF THE PREFERRED EMBODIMENT

Figure 1:
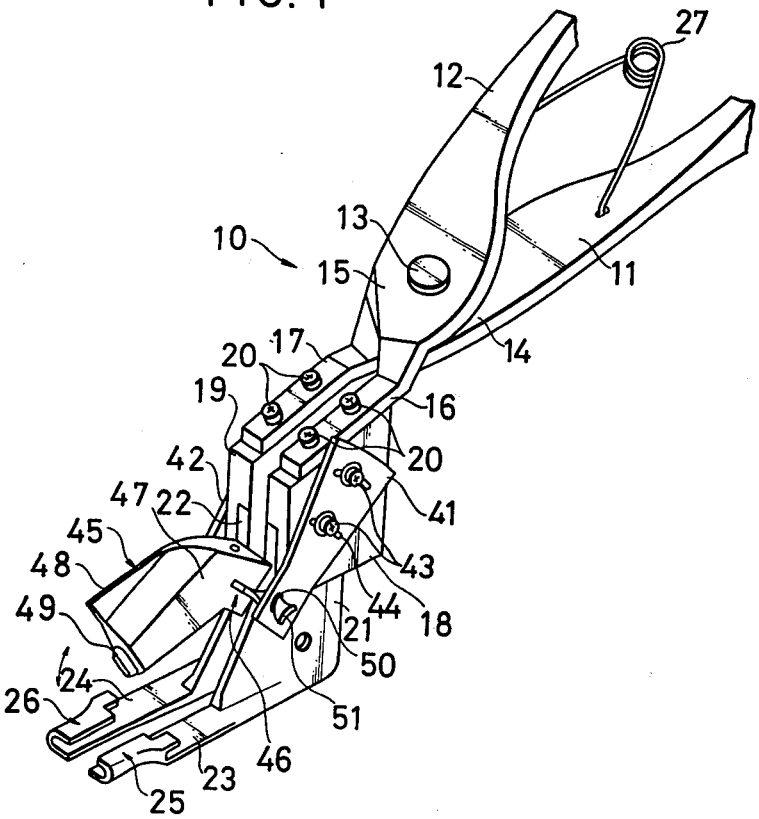
FIG. 1 is a perspective view of an element rows coupling tool provided in accordance with the invention.

In FIG. 1, an element rows coupling tool 10 comprises a pair of handles or levers 11,12 pivoted by means of a pin 13 to one another across mutually sliding portions 14,15. The levers 11,12 have arms 16,17, respectively, to which a pair of respective blocks 18,19 are secured by means of screws 20. The blocks 18,19 support a pair of plates 21,22 having respective legs 23,24. Distal ends of the legs 23,24 are formed into a pair of slider body halves 25,26, respectively. A torsion coil spring 27 is connected between the levers, 11,12 and normally urges the slider body halves 25,26 apart so that the halves are moved toward each other only by urging the levers 11,12 together.

Figure 2:
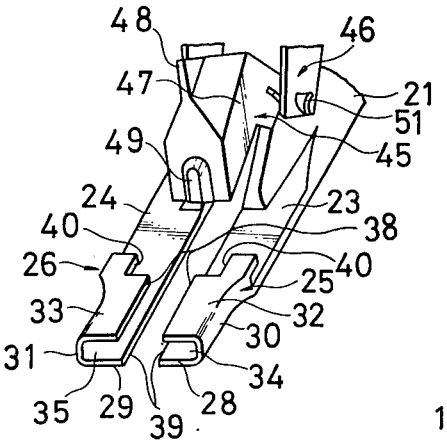
FIG. 2 is an enlarged perspective view of slider-forming means disposed at a front end of the tool.
Figure 4:
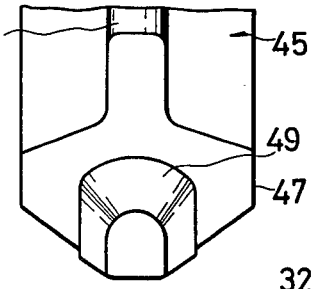
FIG. 4 is a front elevational view, on an enlarged scale, of the slider-forming means with its slider body halves receiving element rows.
Figure 4:
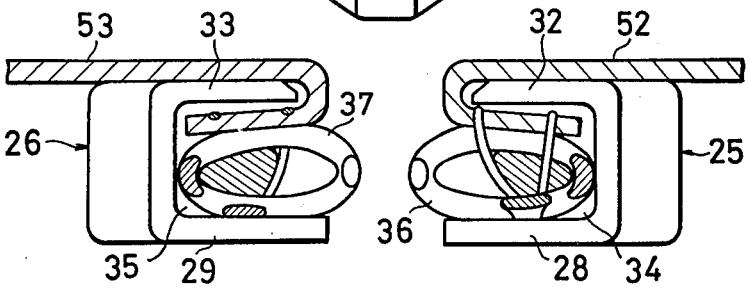
Figure 5:
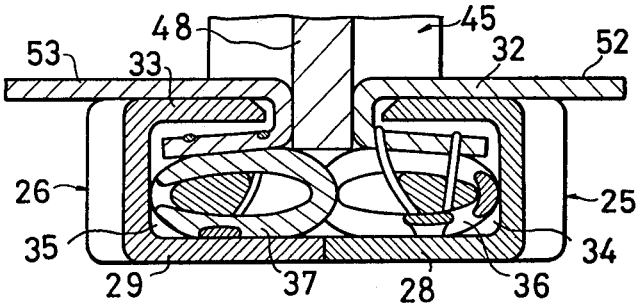
FIG. 5 is an enlarged cross-sectional view taken along line V—V of FIG. 3 with the opposed elements being just about to engage together.
Figure 6:
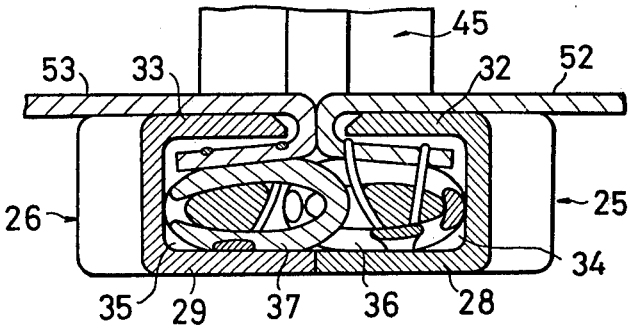
FIG. 6 is an enlarged cross-sectional view taken along line VI—VI of FIG. 3 with the elements being interengaged.

The slider body halves 25,26 are formed symmetrically and, when mated together, jointly provide a slider body for use on slide fasteners of the concealed or hidden type. More specifically, as better shown in FIG. 2, the halves 25,26 comprise back panels 28,29 extending from and lying flush with the legs 23,24, respectively, side walls or flanges 30,31 extending perpendicularly from the back panels 28,29, respectively, and inturned forward lips 32,33 extending from the side flanges 30,31 toward each other in parallel with the back panels 28,29, respectively. The side flanges 30,31 and the outer side edges of the back panels 28,29 and of the forward lips 32,33 diverge apart as they extend away from their free ends. There are thus defined a pair of channels 34,35 in the slider body halves 25,26 for guiding therein a pair of rows of fastener elements 36,37 (FIG. 4, 5 and 6). Each of the inturned lips 32,33 has a free side edge 38 terminating short of the vertical plane of a free side edge 39 of one of the back panels 28,29. With this structure, when the slider body halves 25,26 are mated or come together until the back panel 28 abuts against the back panel 29, the inturned lips 32,33 are held from mutual abutment with a small clearance being left therebetween for the passage therethrough of a pair of stringer tapes 52,53 as shown in FIG. 6. The lips 32,33 have recesses 40 at ends where their outer side edges diverge apart.

A pair of support plates 41,42 are carried on and fixed to the outer sides of the blocks 18,19, respectively, by means of screws 43 passing through arcuate slots 44 formed in the upper portions of the support plates 41,42. The support plates 41,42 extend forwardly and downwardly and have their lower portions projecting beyond the blocks 18,19. Between the lower portions of the support plates 41,42, a pivotable member 45 is supported through a motion converting means 46. The pivotable member 45 has a body portion 47 with its front portion wedge-shaped and terminating in a nose portion 48. The body 47 has centrally on its bottom surface a diamond or element guide 49. The bottom of the nose portion 48 serves as an element presser as described later on.

The motion converting means 46 comprises cam grooves or slits 50 formed in the lower portions of the support plates 41,42, and twisted follower plates 51 each fixed to one side of the upper portion of the body portion 47 and extending through one of the cam slits 50. Each of the follower plates 51 is given a twist such that when the support plates 41,42 are moved toward each other, the cam slits 50 slide over the twisted follower plates 51 toward the body portion 47, causing the follower plates 51 to turn about their longitudinal axes and hence enabling the member 45 to pivot downwardly about the follower plates 51. The support plates 41,42 are moved closer until the bottom of the element guide 49 abuts against the upper surface of the legs 23,24 that are held together, the element presser 48 being located between the recesses 40 in the inturned lips 32,33 and extending beyond the latter into the interior of the combined slider body halves 25,26. Thus, the slider body halves 25,26 and the element guide 49, when put together, jointly provide a slider for use on slide fasteners of the concealed type.

When the support plates 41,42 are moved away from each other, the pivotable member 45 is lifted out of engagement with the legs 23,24, and at the same time, the slider body halves 25, 26 are separated away from one another. An angle of inclination of the support plates 41,42 is adjustable via the arcuate slots 44 to hold the element guide 49 in as flat abutment as possible against the mated legs 23,24.

Figure 3:
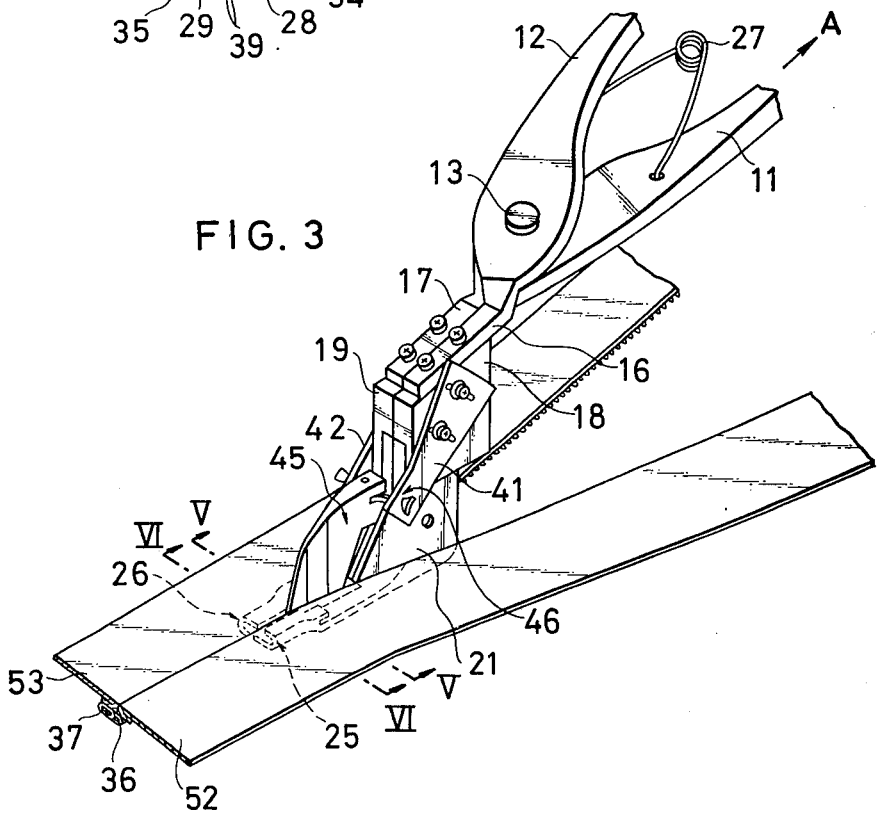
FIG. 3 is a perspective view of the element rows coupling tool which is interengaging the element rows of a pair of slide fastener stringers.

FIG. 3 shows the way in which the tool 10 is used to interengage a pair of rows of elements 36,37 mounted on and along one longitudinal edges of a pair of stringer tapes 52,53, respectively, of a concealed type slide fastener.

For coupling operation, the disengaged element rows are first inserted into the guide channels 34,35 in the separated body halves 25,26, respectively, with the element guide 49 kept away from the halves 25,26, as illustrated in FIG. 4. Next, the levers 11,12 are urged together against the force of the spring 27 to bring the slider body halves 25,26 together and to cause the element guide 49 to be lowered and held against the associated legs 23,24. Then, the tool 10 is pulled along the stringers in the direction of the arrow A in FIG. 3 to couple the rows of the elements 36,37 together.

Since the element presser presses the elements that are interengaged in succession against the back panels 28,29 as shown in FIG. 5, the elements 36,37 are prevented from rising away from the back panels 28,29 and are intermeshed properly within the channels 34,35 as shown in FIG. 6, so that the coupled element rows can be protected from being broken apart when subjected to severe external forces.

While a specific embodiment of the invention has been described, it should be apparent to those skilled in the art that various changes and modifications are possible without departing from the scope of the appended claims.

We claim:

1. A tool for interengaging a pair of element rows in a concealed type slide fastener, comprising:

a. a pair of blocks movable toward and away from each other and normally urged apart;

b. a pair of slider body halves mounted on said blocks, respectively, said slider halves being matable to provide a slider body when said blocks are moved toward each other;

c. a pivotable member operatively connected to said blocks and having centrally on its bottom surface an element guide, said pivotable member being movable pivotally into a position in which said element guide and said slider body halves are put together and jointly provide a slider when said blocks are moved toward each other; and d. means between said blocks and said pivotable member for converting motion of said blocks into pivotal motion of said pivotable member.

2. A tool according to claim 1, further including a pair of levers pivoted to one another and having a pair of arms to which said blocks are secured, and a spring connected between and normally urging said levers apart.

3. A tool according to claim 1, further including a pair of support plates carried on the sides of said blocks and having their lower portions extending beyond said blocks.

4. A tool according to claim 3, said support plates being fixed to said blocks by means of screws passing through arcuate slots formed in the support plates.

5. A tool according to claim 4, said means comprising a pair of twisted follower plates each fixed to one side of said pivotable member and extending through cam slits formed in said lower portions of the support plates.

6. A tool according to claim 1 in which said slider body halves comprise back panels, side flanges and forward lips, and provide therein channels for guiding rows of fastener elements, said forward lips having free side edges terminating short of the vertical planes of free side edges of said back panels, said side flanges and the outer side edges of said back panels and of said forward lips diverging apart as they extend away from their free ends, and said forward lips having recesses at ends where their outer side edges diverge apart.

7. A tool according to claim 6, said pivotable member having a nose portion with its bottom locatable between said recesses in the forward lips and extendible beyond the latter into the combined slider body halves.

* * * * *